United States Patent [19]

Murasaki

[11] Patent Number: 4,715,926

[45] Date of Patent: Dec. 29, 1987

[54] APPARATUS FOR SEVERING AND JOINING JOINT PIECE

[75] Inventor: Ryuichi Murasaki, Toyama, Japan

[73] Assignee: Yoshida Kogyo K. K., Tokyo, Japan

[21] Appl. No.: 922,724

[22] Filed: Oct. 24, 1986

[30] Foreign Application Priority Data

Oct. 26, 1985 [JP] Japan ..... 60-240217

[51] Int. Cl.[4] ..... B32B 31/18; B32B 31/20

[52] U.S. Cl. ..... 156/511; 156/518; 156/519; 156/520; 156/521; 156/530

[58] Field of Search ..... 156/261, 263, 511, 517, 156/518, 519, 520, 530, 157, 159, 521, 522

[56] References Cited

U.S. PATENT DOCUMENTS

| | | | |
|---|---|---|---|
| 2,683,401 | 7/1954 | Smith | 156/511 |
| 3,146,152 | 8/1964 | Seragnoli | 156/519 |
| 3,873,393 | 3/1975 | Bruck et al. | 156/351 |
| 4,581,083 | 4/1986 | Schutz et al. | 156/64 |

*Primary Examiner*—Donald E. Czaja
*Assistant Examiner*—Lori Cuervo
*Attorney, Agent, or Firm*—Hill, Van Santen, Steadman & Simpson

[57] ABSTRACT

An apparatus for automatically severing and joining a joint piece includes feed rollers for feeding a first elongate product along a substantially horizontal path, a feed gripper for feeding a second elongate product along an inclined path extending obliquely to the horizontal path, and a movable cutter movable for transversely cutting off the first elongate product on a first fixed cutter into a product length and then for obliquely cutting off the second elongate product on a second fixed cutter into a joint piece. The movable cutter has a slanted surface for carrying a trailing end of the product length thereon with the joint piece partly overlapping the trailing end. Overlapping portions of the joint piece and the product length are joined to each other into a product with the joint piece having a free end exposed beyond the trailing end.

7 Claims, 19 Drawing Figures

APPARATUS FOR SEVERING AND JOINING JOINT PIECE

BACKGROUND OF THE INVENTION

1. Field of the Invention:

The present invention relates to an apparatus for automatically severing a joint piece from an elongate product such as a surface fastener or a pressure-sensitive adhesive tape and joining the joint piece to the trailing end of a length cut off from another elongate product such as a surface fastener, a slide fastener chain, a film, an ornamental tape, or the like, so that the joint piece can be applied to a coil of the cut-off length on a reel to prevent the coil from being loosened off the reel, or the joint piece and the cut-off piece, if they are severed from surface fastener products, can be used as an adjustable band such as on a hat.

2. Description of the Prior Art:

It has been customary to employ independent processes for severing an elongate product to a desired length, and making a joint piece to be applied to a coil of such a severed length as to prevent the coil from being loosened off a reel, or making a joint piece for use as an adjustable band to be attached to a hat, for example. Before the joint piece is applied to the coil, it is manually attached to the trailing end of the severed length. These independent processes and manual procedure have however been tedious and time-consuming.

SUMMARY OF THE INVENTION

It is an object of the present invention to provide an apparatus for automatically severing a joint piece from an elongate product and joining such a joint piece to a desired length severed from another elongate product.

According to the present invention, there is provided an apparatus for severing and joining a joint piece, comprising first feed means for feeding a first elongate product for a predetermined interval along a substantially horizontal path, second feed means for feeding a second elongatge product for a predetermined interval along an inclined path extending obliquely to the horizontal path, a first fixed cutter disposed ajacent to the horizontal path, a second fixed cutter disposed adjacent to the inclined path, a movable cutter movable for transversely cutting off the first elongate product on the first fixed cutter into a product length and then for obliquely cutting off the second elongate product on the second fixed cutter into a joint piece, the movable cutter having a slanted surface for carrying a trailing end of the product length thereon with the joint piece partly overlapping the trailing end, and joining means for joining overlapping portions of the joint piece and the product length to each other, thereby to produce a product with the joint piece having a free end exposed beyond the trailing end.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
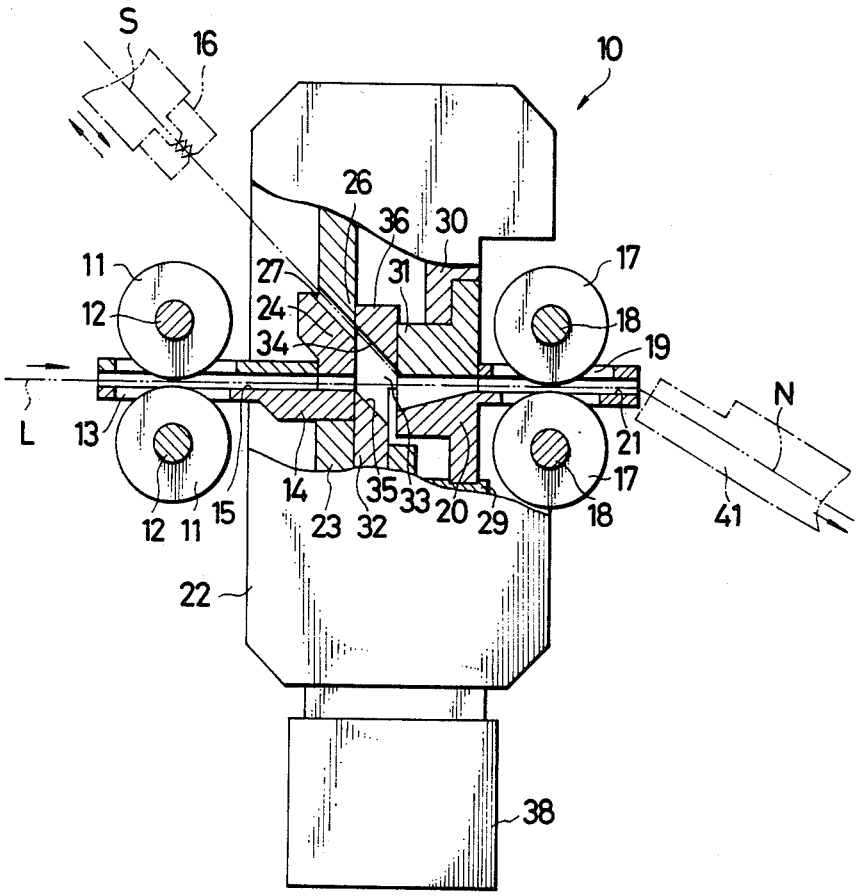
FIG. 1 is a side elevational view, partly in cross section, of an apparatus embodying to the present invention.

Like or corresponding parts are denoted by like or corresponding reference numerals throughout several views.

The principles of the present invention are particularly useful when embodied in an apparatus for severing and jointing a joint piece, such as shown in FIG. 1, generally designated by the reference numeral 10.

The apparatus 10 includes a pair of vertically arranged feed rollers 11 rotatably mounted on a pair of shafts 12, respectively, on one side of the apparatus 10. The feed rollers 11 have their confronting portions disposed in a recess 13 defined in a horizontal feed guide 14 having a horizontal slot 15. A first elongate product L (FIG. 1) such as a surface fastener, a slide fastener chain, a film, an ornamental tape, or the like is supplied into the apparatus 10 by the feed rollers 11 along a horizontal feed path through the slot 15. A second elongate product S such as a surface fastener, a pressure-sensitive tape, or the like, which is to be severed and joined as a joint piece to a cut end of the first elongate product L, is also supplied by a feed gripper 16 positioned above the feed rollers 11 and directed obliquely downwardly. The feed rollers 11 are rotated intermittently by a step motor (not shown) for feeding the first elongate product L intermittently so that a certain desired length thereof will be supplied to the apparatus 10 and then stopped in each operation cycle. The feed gripper 16 is operated in timed relation to the feed rollers 11 to supply a desired length of the second elongate product S to the apparatus 10.

Figure 4A:
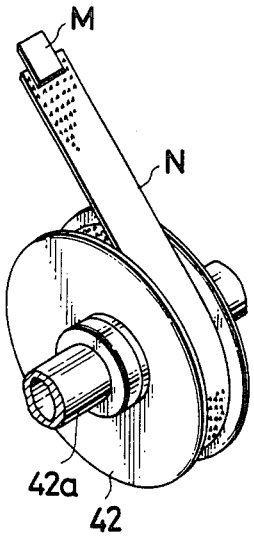
FIGS. 4A and 4B are perspective views showing the manner in which a severed joint piece is applied to an elongate surface fastener product wound on a take-up reel.

The apparatus 10 also includes a pair of vertically arranged auxiliary rollers 17 rotatably mounted respectively on a pair of vertically movable shafts 18 on the opposite side of the apparatus 10. The auxiliary rollers 17 have confronting portions disposed in a vertical recess 19 defined in a horizontal discharge guide 20 having a horizontal slot 21. The auxiliary rollers 17 are rotatable intermittently in synchronism with the feed rollers 11 to assist the first elongate product L in being fed through the apparatus 10. A finished product N is a combination of the cut length of the first elongate product L and a joint piece M (FIGS. 4A and 4B) applied to the cut end of the first elongate product L. When the finished product N is discharged from the apparatus 10, the auxiliary rollers 17 are vertically moved away from each other to allow smooth movement of the product N out of the apparatus 10.

The apparatus 10 includes a housing 22 having a lower support 23 on which the inner end of the feed guide 14 is fixedly mounted. A first fixed cutter 24 is mounted on the inner end of the feed guide 14, the first fixed cutter 24 having a lower cutting edge 25 (FIG. 2) vertically aligned with the inner edge of the feed guide 14. A second fixed cutter 26 is mounted on the first fixed cutter 24. The first and second cutters 24, 26 have respective confronting slanted surfaces which jointly define therebetween an inclined slot 27 through which the second elongate product S can be fed along an inclined feed path which extends obliquely to the horizontal feed path for the first elongate product L. The second fixed cutter 26 has a lower cutting edge 28 (FIG. 2) positioned above the exit end of the slot 27 and vertically aligned with the cutting edge 25 of the first fixed cutter 24.

The housing 22 also has lower and upper supports 29, 30 therein which are horizontally spaced from the support 23 and the first and second fixed cutters 24, 26. The discharge guide 20 is fixedly mounted on the lower support 29. A joining block 31 is attached to the lower end of the upper support 30 in vertically spaced relation to the discharge guide 20.

The apparatus 10 also includes a movable cutter 32 positioned between the feed guide 14 and the discharge guide 20 and vertically movable in a direction substantially normal to the direction in which the first elongate product L travels from the feed guide 14 to the discharge guide 20. The movable cutter 32 has a through-hole 33 defined between an upper slanted surface 34 and a lower slanted surface 35 spaced downwardly from and parallel to the upper slanted surface 34. The upper and lower slanted surfaces 34, 35 are inclined progressively downwardly toward the discharge guide 20. Before the movable cutter 32 is moved upwardly, the through-hole 33 is positioned in communication with the horizontal slots, 15, 21 and the inclined slot 27, and the upper slanted surface 34 lies continuously flush with the slanted surface of the second fixed cutter 26 which defines the inclined slot 27. Therefore, the portion of the movable cutter 32 above the through-hole 33 serves as a guide 36 for guiding the second elongate product S along a downwardly inclined guide path into the movable cutter 32. The lower slanted surface 35 has an upper edge 37 (FIG. 2) serving as a cutting edge which will coact with the cutting edges 25, 28 to cut off the first and second elongate products L, S, respectively. The movable cutter 32 can be actuated by an air cylinder 38 coupled thereto and disposed below the housing 22. The movable cutter 32 may be operated by any of other suitable actuators such as a hydraulic cylinder, a solenoid, a crank mechanism, and the like.

Figure 2:
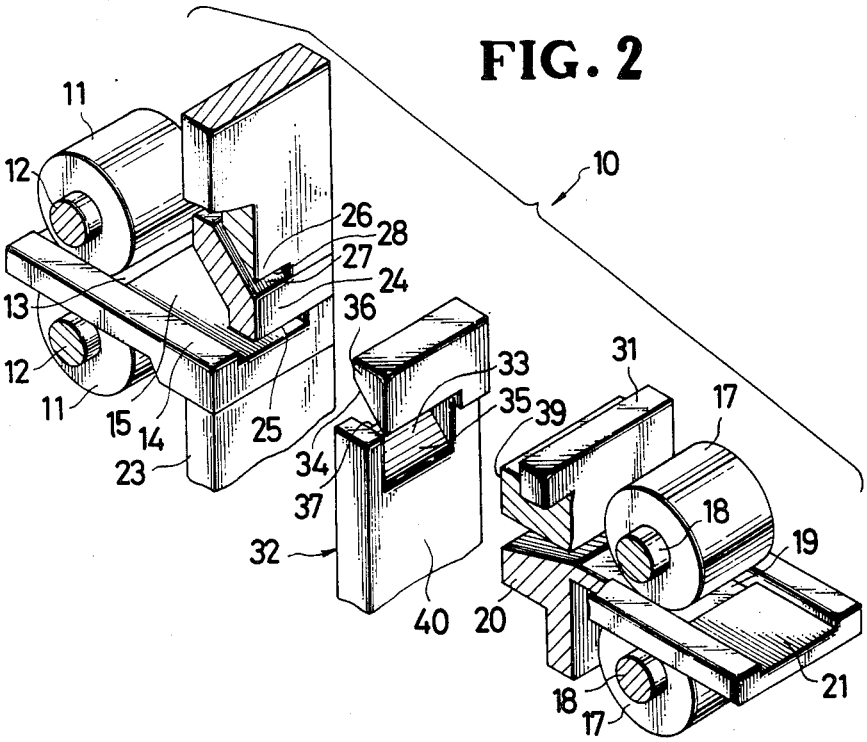
FIG. 2 is a fragmentary exploded perspective view of the apparatus shown in FIG. 1.

The second elongate product S can be adhered to the first elongate product L under pressure. Where the first elongate product L is a surface fastener having loops or hooks on its one surface, the second elongate product S is a surface fastener having hooks or loops on its surface facing the first elongate product L. Where the first elongate product L is a slide fastener chain, a film, an ornamental tape, or the like, the second elongate product S is a pressure-sensitive adhesive tape with a pressure-sensitive adhesive layer coated on its back. As shown in FIG. 2, the joining block 31 has a vertical surface 39 facing the movable cutter 32, and the movable cutter 32 has a vertical surface 40 lying below the through-hole 33 and confronting the vertical surface 39 of the joining block 31.

Figure 3:
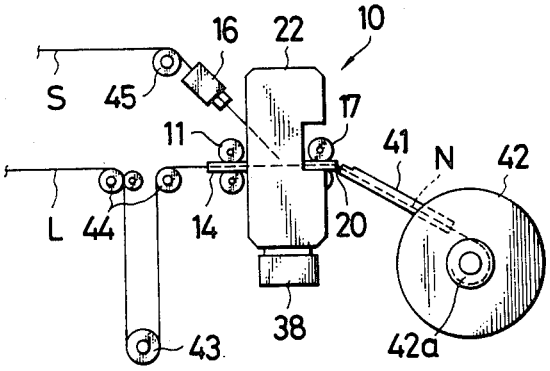
FIG. 3 is a side elevational view of the apparatus of FIG. 1, also showing arrangements for feeding elongate products and a take-up reel.

As shown in FIG. 3, a pivotable discharge tray 41 is positioned downstream of the auxiliary rollers 17 with respect to the direction of travel of the product N from the apparatus 10, the discharge tray 41 being inclined downwardly toward a take-up reel 42. The take-up reel 42 is removably mounted on a rotatable shaft **42*a* for winding the product N thereon. The discharge tray 42 has a lower end that is located in the take-up reel 42 for direct delivery of the product N onto the take-up reel 42. As the number of turns of the product N on the take-up reel 42 is increased, the discharge tray 41 is progressively raised to allow the product N to be smoothly wound on the take-up reel 42. While the first elongate product L is being supplied into the apparatus 10, it is tensioned by a tension roller 43 which is rollingly placed on the first elongate product L between a pair of idler rollers 44. The second elongate product S is delivered over an idler roller 45 into the feed gripper 16**.

Figure 4B:
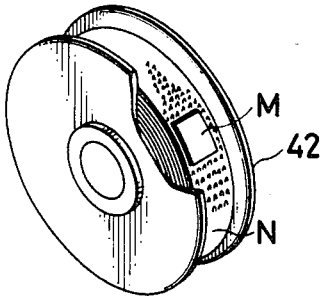
Figure 5A:
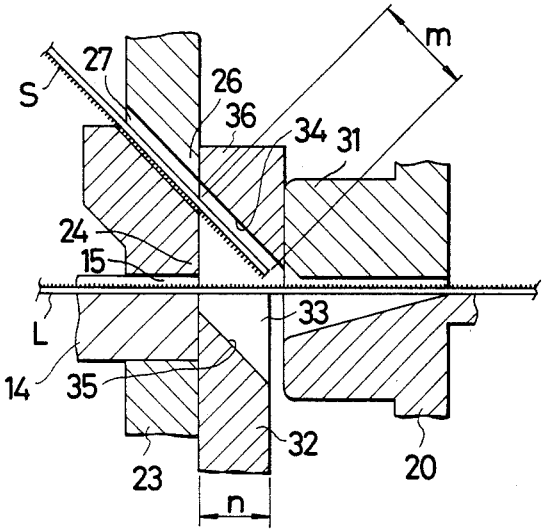
FIGS. 5A through 5D are fragmentary cross-sectional views of the apparatus, illustrating a succession of steps of operation thereof.
Figure 5B:
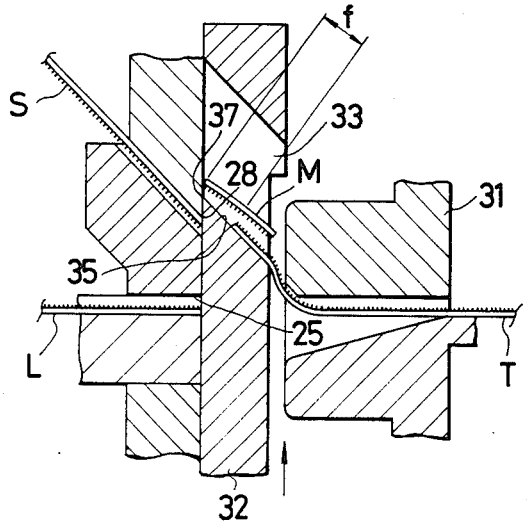

Operation of the apparatus 10 will be described with reference to FIGS. 5A through 5D. In FIGS. 5A through 5D, the first elongate product L is shown as a surface fastener having hooks or loops, and the second elongate product S is shown as a surface fastener having loops or hooks for face-to-face mating engagement with the first elongate product L. The first elongate product L is fed through the apparatus 10 and is stopped when its leading end portion of a predetermined length is wound on the take-up reel 42 (FIG. 3). As shown in FIG. 5A, the second elongate product S is supplied obliquely through the inclined slot 27 toward the first elongate product L by the feed gripper 16 which moves obliquely toward the inclined slot 27. The supply of the second elongate product S is stopped when its leading end is just about to reach the first elongate product L. Then, the movable cutter 32 is moved upwardly, as shown in FIG. 5B, to cause the cutting edge 37 thereof to cut off the first elongate product L on the cutting edge 25 of the first fixed cutter 24, thereby producing a severed length T of the first elongate product L. The movable cutter 32 is continuously lifted to carry the trailing end portion of the product length T on the lower slanted surface 35, and to cause the cutting edge 37 to cut off the second elongate product S on the cutting edge 28 into a joint piece M, which is partly placed over the trailing end portion of the product length T. The joint piece M has a length m which is substantially equal to the length of the lower slanted surface 35 and which is larger than the thickness n of the movable cutter 32. Since the movable cutter 32 has been substantially raised above the horizontal path of the first elongate product L, the trailing end of the product length T is positioned approximately halfway on the lower slanted surface 35. Therefore, when the joint piece M overlies the trailing end of the product length T on the lower slanted surface 35, a rear portion f of the joint piece M does not overlap the trailing end of the product length T and is positoned as a free exposed end over the lower slanted surface 35, as illustrated in FIG. 5B. The free end f of the joint piece M will be applied to the final layer of the product length T on the reel 42 to prevent the wound product N from being loosened off the reel 42, as shown in FIG. 4B. The length of the free end f is dependent on the angle at which the second elongate product S is fed into the apparatus 10.

Figure 5C:
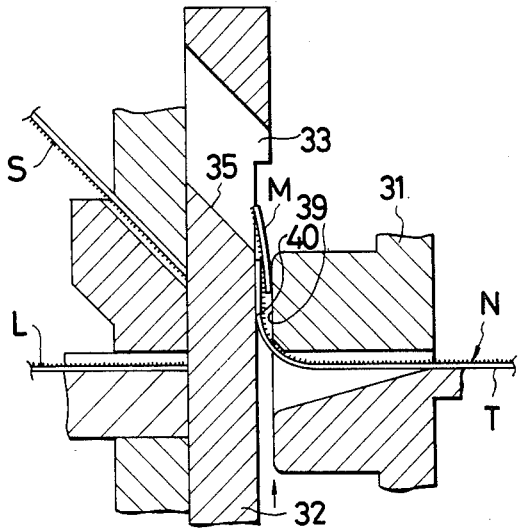
Figure 5D:
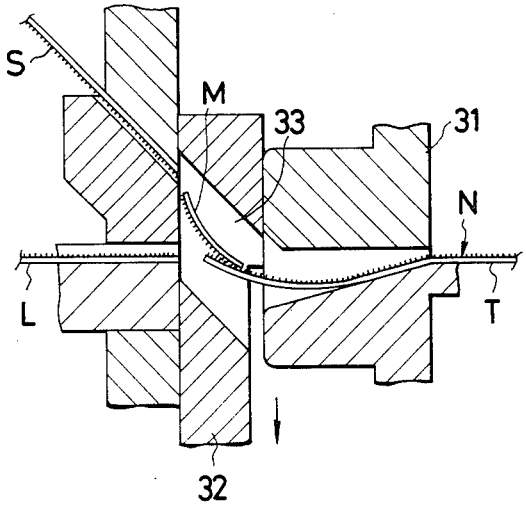

Upon continued ascent of the movable cutter 32, the trailing end of the product length T with the joint piece M thereon is slid off the lower slanted surface 35, as shown in FIG. 5C, and pinched between the confronting vertical surfaces 39, 40 of the joining block 31 and the movable cutter 32. The joint piece M is therefore firmly attached to the product length T. Then, the movable cutter 32 is lowered to release the joint piece M and the trailing end of the product length T into the through-hole 33, as shown in FIG. 5D. The shaft 42*a* (FIG. 4A) is rotated to enable the reel 42 to wind the product length T as the product N. At this time, the auxiliary rollers 17 (FIG. 1) are moved apart from each other to allow smooth travel of the product length T through the tray 41 toward the reel 42. Finally, the free end f of the joint piece M is pressed against the outermost final layer of the wound product length T to secure the coil of the product N against the danger of loosening off the reel 42, as shown in FIG. 4B.

Figure 6A:
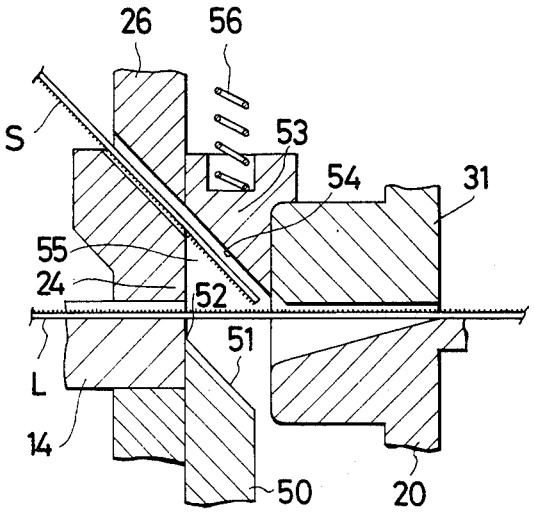
FIGS. 6A and 6B are fragmentary cross-sectional views showing successive steps of operation of an apparatus according to another embodiment of the present invention.
Figure 6B:
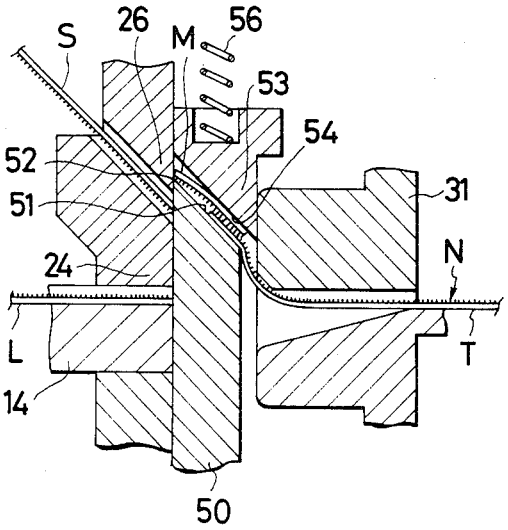

FIGS. 6A and 6B illustrate an apparatus according to another embodiment of the present invention. A cutter 50 is vertically movably disposed between the feed and discharge guides 14, 20 and has a slanted surface 51 on its upper end, the slanted surface 51 having an upper cutting edge 52 for cutting off the first and second elongate products L, S. A guide/joining block 53 is disposed separately above the movable cutter 50 and has a slanted surface 54 extending parallel to and spaced from the slanted surface 51 in confronting relation. The slanted surfaces 51, 54 jointly define a hole 55 therebetween for passage of the first and second elongate products L, S. The guide/jointing block 53 is normally urged by a compression coil spring 56 to move downwardly toward the movable cutter 50. After the first and second elongate products L, S are cut off by the movable cutter 50, as shown in FIG. 6B, the joint piece M and the trailing end of the product length T are securely applied to each other by being sandwiched between the slanted surfaces 51, 54 of the movable cutter 50 and the guide/joining block 53. The guide/-jointing block 53 therefore serves to both guide the second elongate product S along the slanted surface 54 and join the joint piece M to the trailing end of the product length T.

Figure 7A:
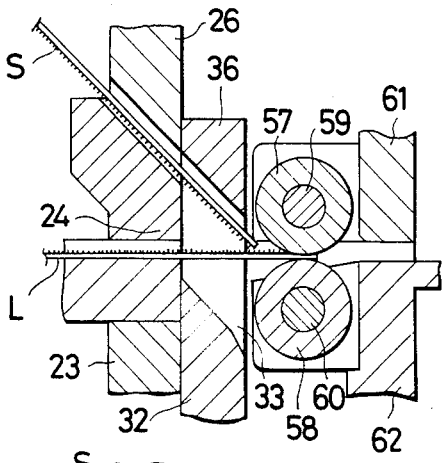
FIGS. 7A through 7C are fragmentary cross-sectional views showing successive steps of operaton of an apparatus according to still another embodiment of the present invention.
Figure 7B:
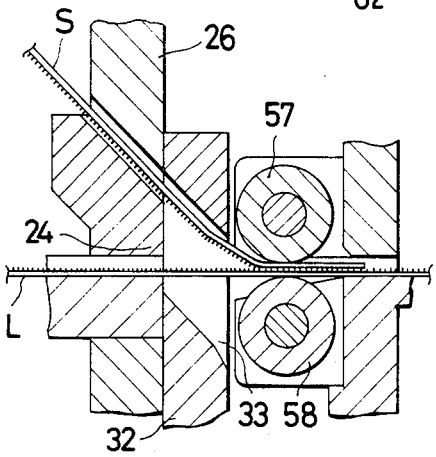
Figure 7C:
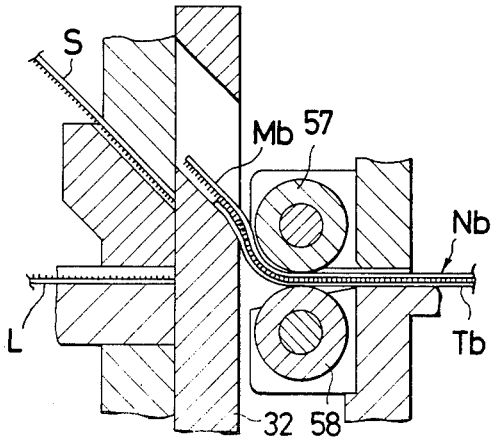

According to still another embodiment shown in FIGS. 7A through 7C, a pair of presser rollers 57, 58 is disposed downstream of the movable cutter 32, the presser rollers 57, 58 being rotatably mounted respectively on a pair of shafts 59, 60 supported on a pair of upper and lower supports 61, 62 disposed in the apparatus housing. As illustrated in FIGS. 7B and 7C, the presser rollers 57, 58 press a joint piece Mb (FIG. 7C), which is severed by the movable cutter from the second elongate product S, against a product length Tb cut off the first elongate product L, thus producing a product Nb. The joint piece Mb may be increased in length by increasing the thickness of the movable cutter 32 (FIGS. 7A through 7C) and feeding the first and second elongate products L, S over an increased interval, before they are cut off by the movable cutter 32. The second elongate product S can then continuously be applied to the first elongate product L by the presser rollers 57, 58 over the increased length, as shown in FIG. 7B.

Figure 8A:
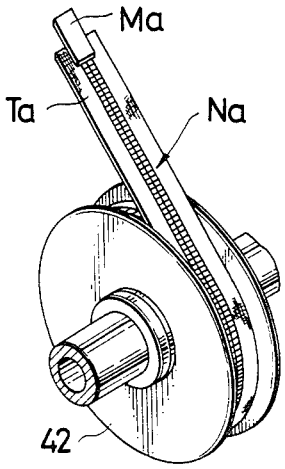
FIGS. 8A and 8B are perspective views showing the manner in which a severed joint piece is applied to an slide fastener chain wound on a take-up reel.
Figure 8B:
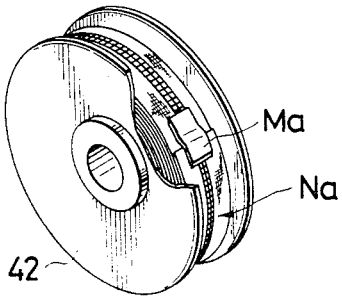

In FIGS. 8A and 8B, the first elongate product is a slide fastener chain, which is severed by the apparatus of the invention into a slide fastener chain length Ta. The second elongate product is a pressure-sensitive adhesive tape, which is severed into a pressure-sensitive joint piece Ma. The joint piece Ma is applied to the trailing end of the slide fastener chain length Ta wound on the reel 42, as shown in FIG. 8A, and is adhered to the final layer of the slide fastener chain length Ta on the reel 42, as shown in FIG. 8B.

Figure 9A:
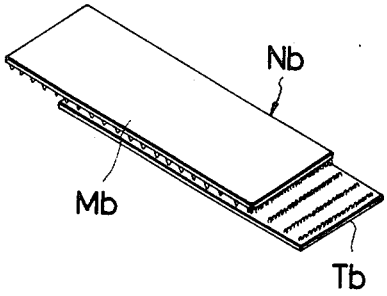
FIG. 9A is a perspective view of an adjustable band including a joint piece produced by the apparatus shown in FIGS. 7A through 7C.
Figure 9B:
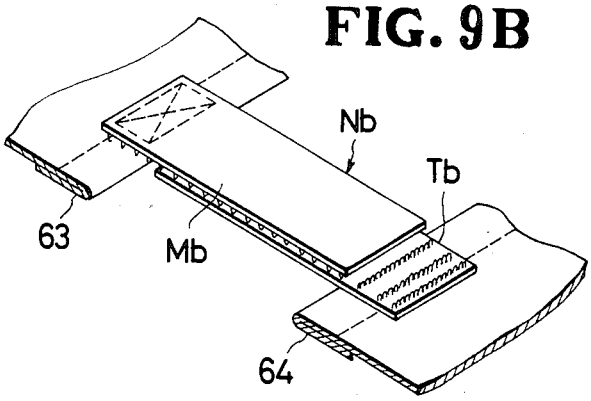
FIG. 9B is a perspective view of the adjustable band of FIG. 9A which is sewn to a fabric piece.
Figure 10:
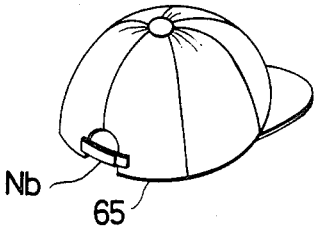
FIG. 10 is a perspective view of a hat to which the adjustable band is attached.

The product Nb manufactured by the apparatus shown in FIGS. 7A through 7C is particularly suitable for use as an adjustable band as shown in FIGS. 9A, 9B, and 10, since the product Nb may be of an increased length. The product Nb can be attached to the rear of a hat 65 (FIG. 10) by sewing the opposite exposed free ends of the joint piece Mb and the product length Tb, which have been joined to each other in staggered relation, to respective confronting fabric edges 63, 64 of the hat 65, as shown in FIG. 9B. In FIGS. 9A and 9B, the product length Tb is shown as having loops, and the joint piece Mb is shown as having hooks engaging the loops.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for severing and joining a joint piece, comprising:

(a) first feed means for feeding a first elongate product for a predetermined interval along a substantially horizontal path;

(b) second feed means for feeding a second elongate product for a predetermined interval along an inclined path extending obliquely to said horizontal path;

(c) a first fixed cutter disposed ajacent to said horizontal path;

(d) a second fixed cutter disposed adjacent to said inclined path;

(e) a movable cutter movable for tranversely cutting off the first elongate product on said first fixed cutter into a product length and then for obliquely cutting off the second elongate product on said second fixed cutter into a joint piece, said movable cutter having a slanted surface for carrying a trailing end of the product length thereon with the joint piece partly overlapping said trailing end; and (f) joining means for joining overlapping portions of the joint piece and the product length to each other, thereby to produce a product with the joint piece having a free end exposed beyond said trailing end.

2. An apparatus according to claim 1, said first and second fixed cutters jointly defining an inclined slot extending along said inclined path for passage therethrough of the second elongate product.

3. An apparatus according to claim 1, said movable cutter having a through-hole for passage of the first and second elongate products from said first and second feed means, said through-hole being defined by said slanted surface and a second slanted surface spaced from and parallel to said first-mentioned slanted surface.

4. An apparatus according to claim 3, said movable cutter including a guide having said second slanted surface for guiding the second elongate product along said inclined path before the second elongate product is cut off by said movable cutter and said second fixed cutter.

5. An apparatus according to claim 4, said joining means comprising a joining block disposed downstream of said guide in said horizontal path for coacting with said movable cutter to sandwich the joint piece and said product length to join them to each other.

6. An apparatus according to claim 1, further including a guide/joining block having a second slanted surface spaced from and parallel to said first-mentioned slanted surface for guiding the second elongate product along said inclined path before the second elongate product is cut off by said movable cutter and said second fixed cutter, and a spring acting on said guide/joining block for normally urging the latter toward said movable cutter to sandwich the joint piece and said product length to join them to each other.

7. An apparatus according to claim 1, said joining means comprising a pair of rollers rotatably disposed downstream of said movable cutter in said horizontal path for sandwiching the joint piece and said product length therebetween to join them to each other.

* * * * *